US011572798B2

(12) United States Patent
Poick et al.

(10) Patent No.: US 11,572,798 B2
(45) Date of Patent: Feb. 7, 2023

(54) VARIABLE GUIDE VANE FOR GAS TURBINE ENGINE

(71) Applicant: PRATT & WHITNEY CANADA CORP., Longueuil (CA)

(72) Inventors: Daniel Poick, Brampton (CA); David Batch, Mississauga (CA)

(73) Assignee: PRATT & WHITNEY CANADA CORP., Longueuil (CA)

( * ) Notice: Subject to any disclaimer, the term of this patent is extended or adjusted under 35 U.S.C. 154(b) by 34 days.

(21) Appl. No.: 17/105,831

(22) Filed: Nov. 27, 2020

(65) Prior Publication Data

US 2022/0170380 A1 Jun. 2, 2022

(51) Int. Cl.
*F01D 17/16* (2006.01)
*F04D 29/56* (2006.01)

(52) U.S. Cl.
CPC ..... *F01D 17/162* (2013.01); *F04D 29/563* (2013.01); *F05D 2230/64* (2013.01); *F05D 2240/122* (2013.01); *F05D 2240/80* (2013.01)

(58) Field of Classification Search
CPC ..... F01D 17/162; F01D 5/143; F04D 29/563; F04D 19/02; F05D 2230/64; F05D 2230/80; F05D 2230/123; F05D 2230/124; F05D 2250/712
See application file for complete search history.

(56) References Cited

U.S. PATENT DOCUMENTS 4,231,703 A * 11/1980 Weiler ..... F01D 17/162 415/147
6,283,705 B1 * 9/2001 Rice ..... F04D 29/563 415/162
6,843,638 B2 1/2005 Hidalgo et al.
7,806,652 B2 * 10/2010 Major ..... F01D 5/147 416/223 R
7,963,742 B2 * 6/2011 Clouse ..... F01D 5/147 415/209.3
7,980,815 B2 * 7/2011 Cloarec ..... F01D 17/162 415/160
8,123,471 B2 2/2012 Mielke et al.
(Continued)

FOREIGN PATENT DOCUMENTS

EP 1988259 A2 11/2008
EP 3246518 A1 11/2017
GB 2437298 A * 10/2007 ..... F01D 11/001

OTHER PUBLICATIONS

European Patent Office, Communication re. extended European search report for European patent application No. 21211096.9, dated Apr. 7, 2022.

*Primary Examiner* — David E Sosnowski
*Assistant Examiner* — Wayne A Lambert
(74) *Attorney, Agent, or Firm* — Norton Rose Fulbright Canada LLP

(57) ABSTRACT

A variable guide vane (VGV) described herein includes an airfoil for interacting with a fluid inside a gas path of a gas turbine engine. The airfoil is mounted to a button and rotatable with the button about an axis. The button includes a platform surface defining part of the gas path adjacent the airfoil during use. The platform surface of the button includes a depression for receiving therein part of an adjacent VGV and providing clearance between adjacent VGVs at aggressive vane angles.

20 Claims, 9 Drawing Sheets

(56) References Cited

U.S. PATENT DOCUMENTS

| | | | | |
|---|---|---|---|---|
| 8,672,618 | B2 * | 3/2014 | Guemmer | F01D 17/162 415/162 |
| 8,721,269 | B2 * | 5/2014 | Abadie | F01D 17/162 415/160 |
| 9,631,504 | B2 * | 4/2017 | Bentley | F01D 9/02 |
| 9,638,212 | B2 * | 5/2017 | Marshall | F01D 9/04 |
| 10,202,859 | B2 * | 2/2019 | Biemar | F01D 9/042 |
| 10,458,321 | B2 * | 10/2019 | Poltoratski | F01D 9/041 |
| 2008/0131268 | A1 | 6/2008 | Guemmer | |

* cited by examiner

VARIABLE GUIDE VANE FOR GAS TURBINE ENGINE

TECHNICAL FIELD

The disclosure relates generally to aircraft engines, and more particularly to variable orientation guide vanes of gas turbine engines.

BACKGROUND

Variable orientation guide vanes, also called variable guide vanes (VGVs), are commonly used in aircraft gas turbine engine compressors and fans, and in some turbine designs. Typically, VGVs have spindles through their rotational axis that penetrate the casing and allow the VGVs to be rotated using an actuation mechanism. VGVs direct air onto rotors of the gas turbine engine at a desired angle of incidence for engine performance and efficiency. In some operating conditions of gas turbine engines, it can be desirable to orient the VGVs at aggressive vane angles. However, the range of motion of VGVs can be limited in existing arrangements of VGVs. Improvement is desirable.

SUMMARY

In one aspect, the disclosure describes a variable orientation guide vane for a gas turbine engine. The variable orientation guide vane comprises:

an airfoil for interacting with a fluid in a gas path of the gas turbine engine, the airfoil having a leading edge and a trailing edge; and a button, the airfoil being mounted to the button and rotatable with the button about an axis during use, the button having a leading end at an angular position corresponding to an angular position of the leading edge of the airfoil relative to the axis, the button including a platform surface for facing the gas path and defining part of the gas path during use, the platform surface including a depression for receiving therein part of an adjacent variable orientation guide vane, the depression defining a sunken portion of the platform surface that is lower than a leading end portion of the platform surface at or adjacent the leading end of the button.

In another aspect, the disclosure describes a variable guide vane assembly for a gas turbine engine. The assembly comprising:

a shroud including a shroud surface defining a first part of an annular gas path of the gas turbine engine, the shroud including a receptacle defined in the shroud surface;

a first vane rotatably mounted inside the annular gas path, the first vane including a button and a first airfoil mounted to the button, the button being received in the receptacle of the shroud, the first button including a platform surface defining a second part of the annular gas path adjacent the first airfoil, the platform surface including a depression defining a sunken portion of the platform surface; and a second vane rotatably mounted inside the annular gas path adjacent the first vane, the second vane including a second airfoil, the second vane being rotatable between: a first orientation where a part of the second airfoil of the second vane is outside of the depression in the platform surface of the first vane; and a second orientation where the part of the second airfoil of the second vane is inside the depression in the platform surface of the first vane.

Embodiments may include combinations of the above features.

In a further aspect, the disclosure describes a method of operating adjacent variable orientation first and second vanes disposed in an annular gas path of a gas turbine engine, the first vane having a first button and a first airfoil mounted to the first button, the second vane having a second button and a second airfoil mounted to the second button, the first and second buttons being rotatably disposed in respective receptacles formed in a shroud defining part of the annular gas path, the first button including a platform surface including a depression defining a sunken portion of the platform surface, the method comprising:

rotating the first and second vanes; and when rotating the first and second vanes, receiving part of the second airfoil of the second vane in the depression formed in the first button of the first vane.

Further details of these and other aspects of the subject matter of this application will be apparent from the detailed description included below and the drawings.

DESCRIPTION OF THE DRAWINGS

Reference is now made to the accompanying drawings, in which.

DETAILED DESCRIPTION

The following disclosure describes variable guide vanes (VGVs), associated assemblies, gas turbine engines and methods. In some embodiments, the VGVs described herein may allow for an expanded range of motion for VGVs and consequently may allow VGVs to adopt more aggressive vane angles. Relatively aggressive vane angles of VGVs may be desirable in some operating conditions of gas turbine engines such as at lower power outputs and/or when idling. In some embodiments, a VGV as described herein may include a button of the VGV that is configured to provide additional clearance between adjacent VGVs to widen spatial constraints and allow for adjacent (i.e., neighboring) VGVs to adopt relatively aggressive vane angles without colliding with each other.

The terms "connected" and "coupled" may include both direct connection/coupling (in which two elements contact each other) and indirect connection/coupling (in which at least one additional element is located between the two elements).

The terms "substantially" and "generally" as used herein may be applied to modify any quantitative representation which could permissibly vary without resulting in a change in the basic function to which it is related.

Aspects of various embodiments are described through reference to the drawings.

Figure 1:
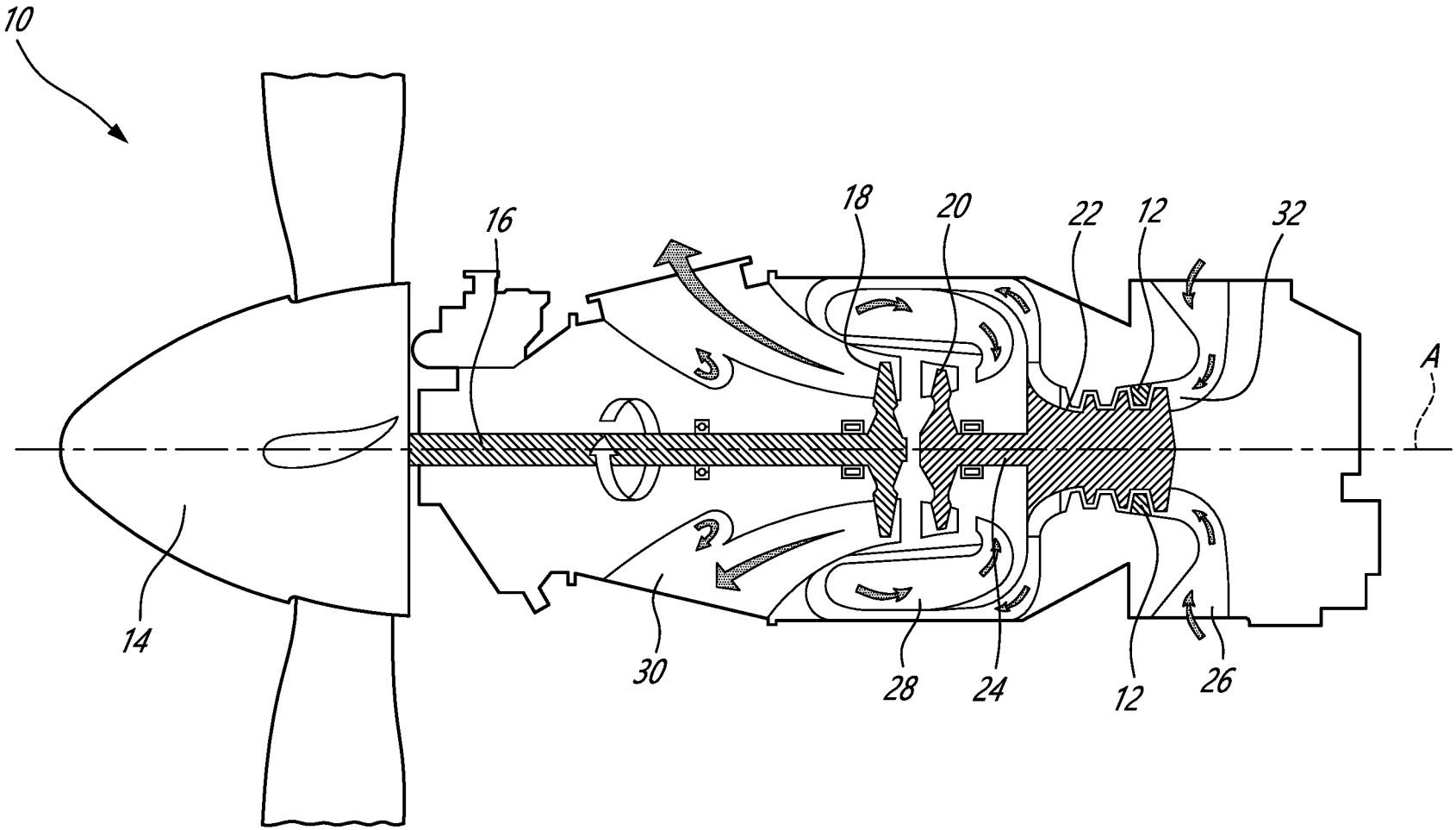
FIG. 1 shows an axial cross-section view of an exemplary turboprop gas turbine engine including variable orientation guide vanes as described herein.

FIG. 1 is a schematic axial cross-section view of an exemplary reverse flow turboprop gas turbine engine 10 comprising one or more VGVs 12, as described herein. Even though the following description and FIG. 1 specifically refer to a turboprop gas turbine engine as an example, it is understood that aspects of the present disclosure may be equally applicable to other types of gas turbine engines including turboshaft and turbofan gas turbine engines. Gas turbine engine 10 may be of a type preferably provided for use in subsonic flight to drive a load such as propeller 14 via low-pressure shaft 16 (sometimes called "power shaft") coupled to low-pressure turbine 18. Propeller 14 may be coupled to low-pressure shaft 16 via a speed-reducing gearbox (not shown) in some embodiments. Low-pressure turbine 18 and low-pressure shaft 16 may be part of a first spool of gas turbine engine 10 known as a low-pressure spool. Gas turbine engine 10 may comprise a second or high-pressure spool comprising high-pressure turbine 20, (e.g., multistage) compressor 22 and high-pressure shaft 24.

Compressor 22 may draw ambient air into engine 10 via annular radial air inlet duct 26, increase the pressure of the drawn air and deliver the pressurized air to combustor 28 where the pressurized air is mixed with fuel and ignited for generating an annular stream of hot combustion gas. High-pressure turbine 20 may extract energy from the hot expanding combustion gas and thereby drive compressor 22. The hot combustion gas leaving high-pressure turbine 20 may be accelerated as it further expands, flows through and drives low pressure turbine 18. The combustion gas may then exit gas turbine engine 10 via exhaust duct 30.

In some embodiments, VGVs 12 may be suitable for installation in a core gas path 32 of engine 10. For example, VGVs 12 may be variable inlet guide vanes disposed upstream of compressor 22. Alternatively, VGVs 12 may instead be disposed between two rotor stages of compressor 22. Gas path 32 may have a substantially annular shape and may have central axis A, which may correspond to a central axis of engine 10, and may also correspond to an axis of rotation of a spool including compressor 22. A plurality of VGVs 12 may be angularly distributed within annular gas path 32 and about central axis A. In other words, the plurality of VGVs 12 may be arranged to define a circular array of VGVs 12 within the annular gas path 32. VGVs 12 may have a controllably variable orientation that may be controlled via a controller of engine 10 based on operating parameters of engine 10. In some embodiments, the orientation of VGVs 12 may be synchronously varied via a unison ring or via another suitable drive mechanism.

Figure 2B:
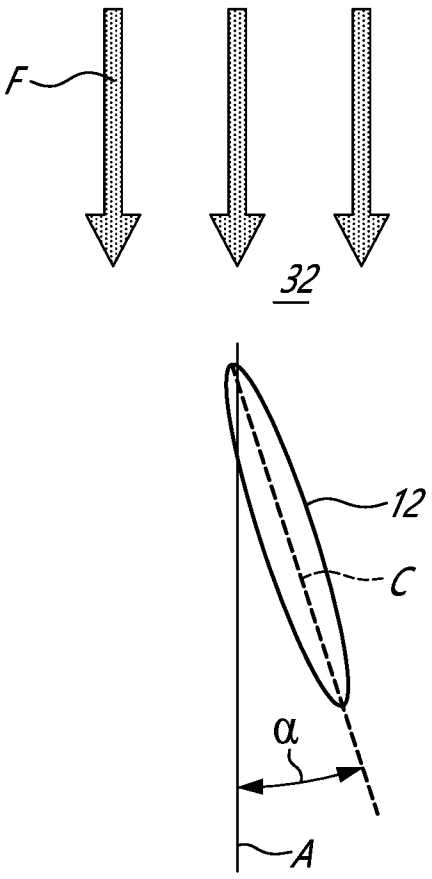
FIGS. 2A and 2B are schematic representations of a variable orientation guide vane at different angular positions.
Figure 2A:
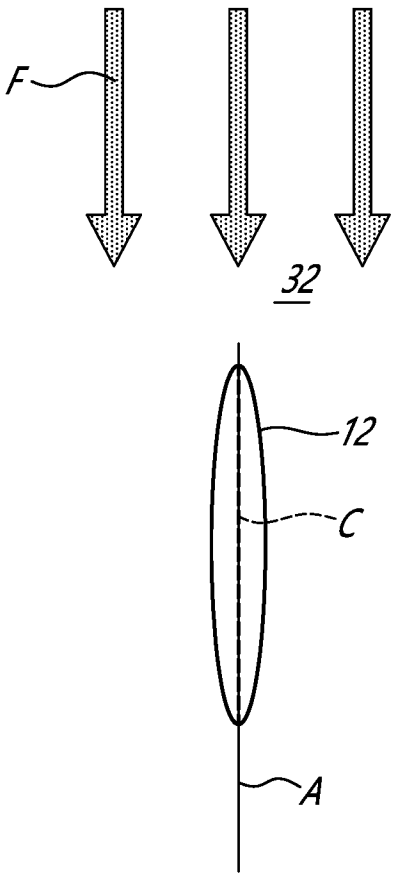

FIGS. 2A and 2B are schematic representations of one VGV 12 at different orientations relative to central axis A and also relative to fluid flow F in annular gas path 32. FIG. 2A shows a situation where VGV 12 is aligned with central axis A. In other words, a chord C of VGV 12 may be substantially parallel with central axis A. This orientation of VGV 12 may correspond to a reference (e.g., zero) orientation where vane angle $\alpha$ equals 0. In this situation, annular gas path 32 may be substantially wide open and VGVs 12 may provide relatively little influence on flow F at the current angle of incidence with flow F.

FIG. 2B shows a situation where VGV 12 is oriented at a non-zero vane angle $\alpha$ where VGV 12 is oriented obliquely to central axis A and to the general direction of flow F. In this situation, the effective area of annular gas path 32 may be reduced by the orientation of the cooperating plurality of VGVs 12 in comparison with that of FIG. 2A. VGVs 12 may also provide a greater influence on flow F in this orientation. VGVs 12 may be rotatable within a range of orientations (e.g., vane angle $\alpha$). In some embodiments, VGVs 12 may be rotatable in one or both directions from the zero angular position of FIG. 2A so that vane angles $\alpha$ may be positive or negative relative to central axis A for example. In some embodiments, the range of orientations of VGVs 12 may be symmetric or asymmetric about the zero position. For example, VGVs 12 may be rotatable to a more aggressive vane angle $\alpha$ in one direction than in the opposite direction.

Figure 3:
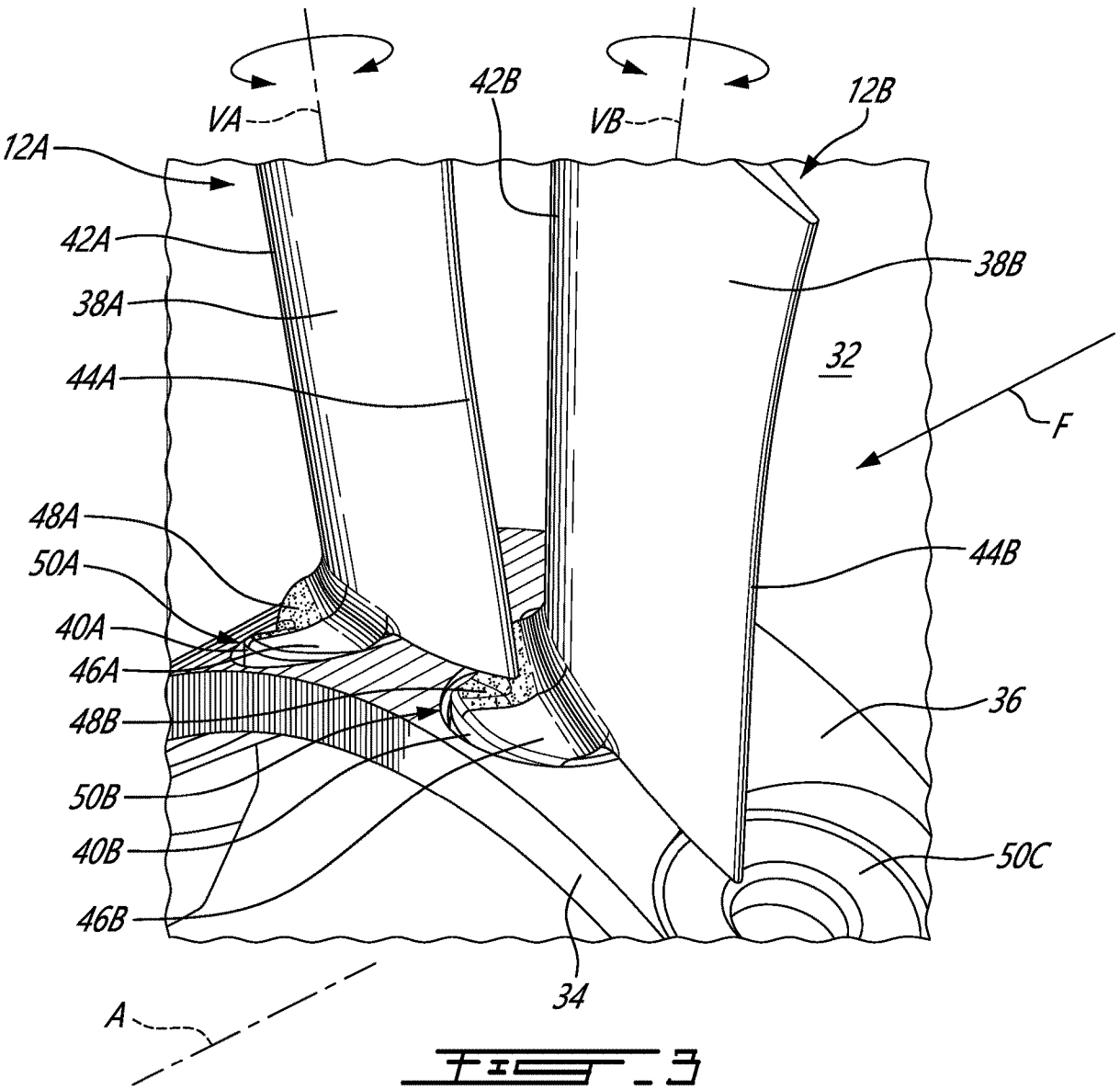
FIG. 3 is a tridimensional view of two exemplary adjacent variable orientation guide vanes rotatably mounted in an annular gas path of a gas turbine engine.

FIG. 3 is a tridimensional view of two exemplary adjacent VGVs 12A, 12B rotatably mounted to shroud 34. Shroud 34 may be a radially-inner shroud ring relative to annular gas path 32. Shroud 34 may include shroud surface 36 defining part of a radially-inner boundary of annular gas path 32. VGV 12A may include airfoil 38A mounted to button 40A. Airfoil 38A may interact with fluid flow F inside of gas path 32 and may include leading edge 42A and trailing edge 44A. Airfoil 38A and button 40A may be rotatable as a unit about vane axis VA. Vane axis VA may be oriented partially radially or substantially entirely radially relative to central axis A. Airfoil 38A may be integrally formed (e.g., cast, machined) with button 40A or may be separately formed and attached to button 40A by welding for example. Button 40A may define a platform for VGV 12A and may include platform surface 46A for facing gas path 32 and defining part of gas path 32 adjacent airfoil 38 and at a radial extremity of airfoil 38A. Platform surface 46A may include depression 48A for receiving therein part (e.g., a trailing edge) of an adjacent VGV 12. Depression 48A may define a sunken (e.g., concave, recessed) portion of platform surface 46A that is lower than a surrounding portion of platform surface 46A outside of depression 48A. Button 40A may be received in receptacle 50A formed in shroud 34. Receptacle 50A may formed in shroud surface 36 and open to gas path 32.

In some embodiments, VGV 12B may, but not necessarily, be substantially identical to VGV 12A and may be angularly offset from VGV 12A in gas path 32 relative to central axis A. Only two VGVs 12A, 12B are shown in FIG. 3 but it is understood that more than two VGVs 12A, 12B may be circumferentially distributed around shroud 34 and installed in respective receptacles. Receptacle 50C is shown without a VGV installed therein to show an exemplary internal configuration of receptacle 50C. VGV 12B may include airfoil 38B mounted to button 40B. Airfoil 38B may interact with fluid flow F inside of gas path 32 and may include leading edge 42B and trailing edge 44B. Airfoil 38B and button 40B may be rotatable as a unit about vane axis VB. Vane axis VB may be oriented partially radially or substantially entirely radially relative to central axis A. Button 40B may include platform surface 46B including depression 48A for receiving therein part (e.g., trailing edge 44A) of VGV 12A.

FIG. 3 shows shroud 34 being a radially-inner shroud of annular gas path 32 and buttons 40A, 40B being disposed at radially-inner ends of their respective VGVs 12A, 12B. However, it is understood that aspects of this disclosure may also be applied to a radially-outer shroud and to buttons disposed at radially outer ends of their respective VGVs 12A, 12B. For examples, depressions 48A, 48B or other types of cut-outs or recesses could instead, or in addition, be incorporated in radially-outer buttons to provide additional clearance (i.e., prevent interference) between adjacent VGVs 12A, 12B.

Figure 4:
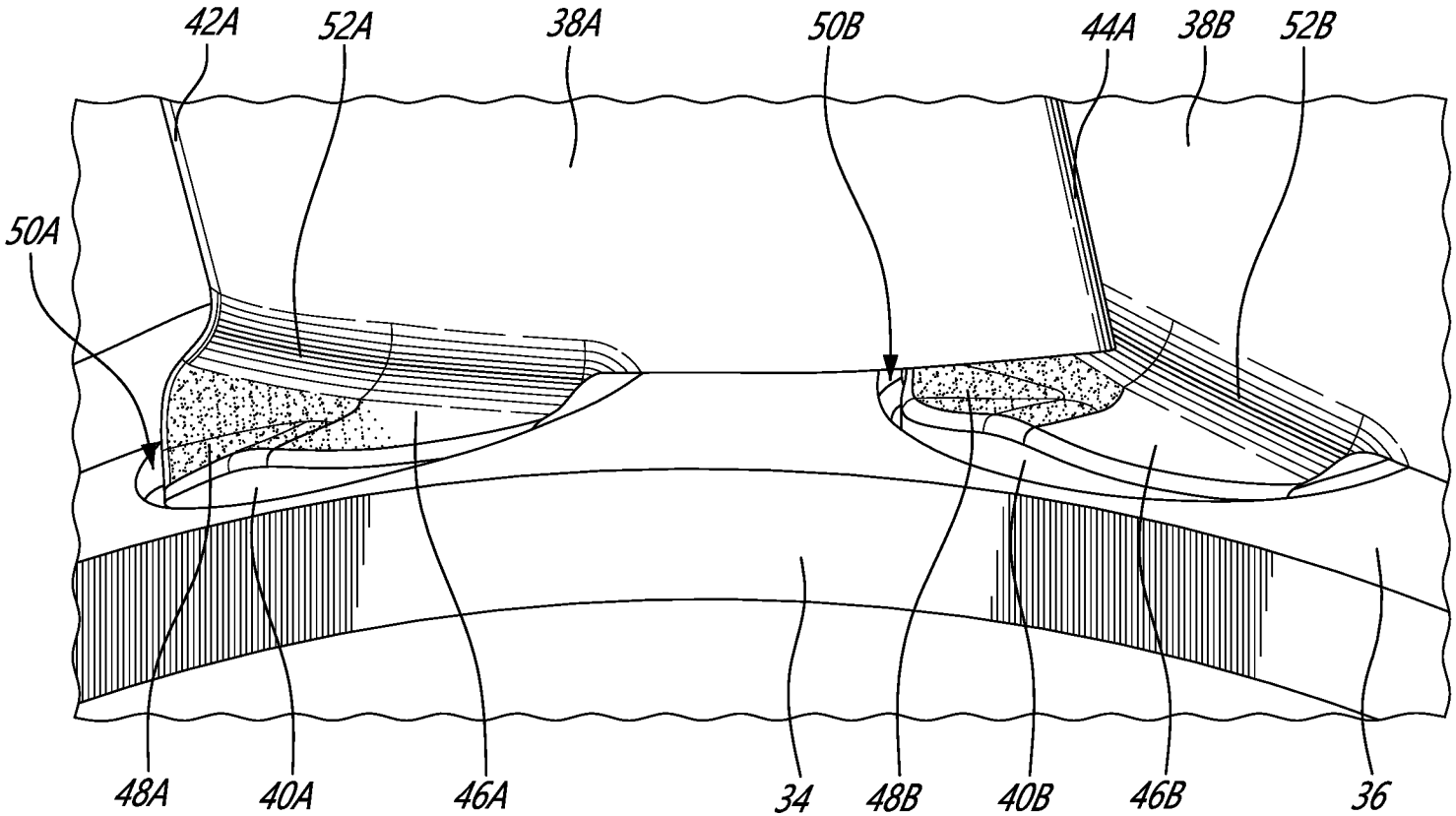
FIG. 4 is an enlarged tridimensional view of parts of the variable orientation guide vanes of FIG. 3.

FIG. 4 is an enlarged tridimensional view of buttons 40A, 40B of VGVs 12A, 12B shown in FIG. 3. VGS 12A, 12B may be rotatable within a range of vane angles α including a first orientation (e.g., α=0 as shown in FIG. 2A) where a part (e.g., trailing edge 44A) of airfoil 38A of VGV 12A is outside of depression 48B of platform surface 46B of VGV 12B. The range of vane angles α may include a more aggressive orientation, as shown in FIG. 4, where the part (e.g., trailing edge 44A) of airfoil 38A of VGV 12A is received inside depression 48B of platform surface 46B of VGV 12B.

The presence of depression 48B may allow part of airfoil 38A to radially overlap button 40B and thereby provide additional clearance to expand the range of orientations of VGV 12A without interference between VGV 12A and VGV 12B. In other words, at the orientation of VGV 12A shown in FIG. 4, part of airfoil 38A may be permitted to overlap a (e.g., partially circular) periphery of button 40B when viewed along vane axis VB. Fillets 52A, 52B may be respectively disposed at junctions of airfoils 38A, 38B with respective buttons 40A, 40B.

Figure 5:
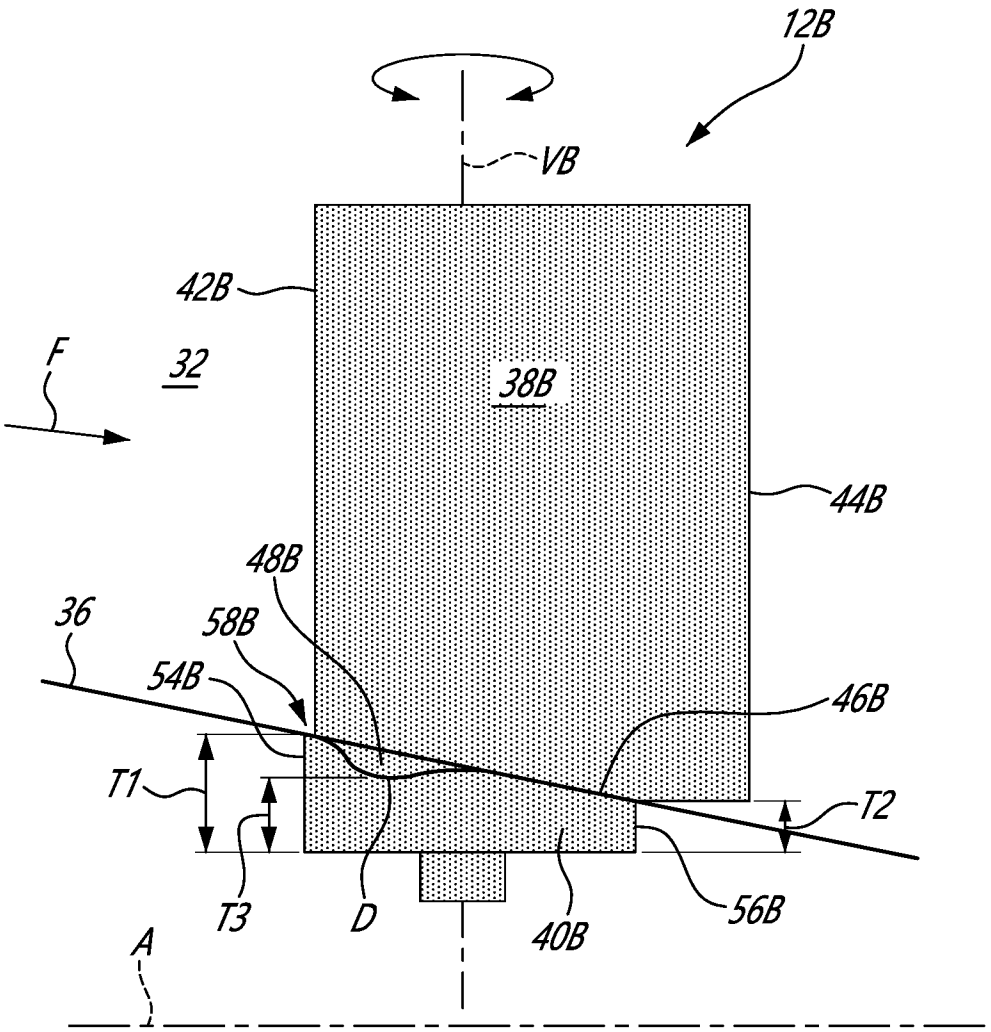
FIG. 5 is a schematic side view of one of the variable orientation guide vanes of FIG. 3 together with a shroud surface.

FIG. 5 is a schematic side view of VGV 12B. In some embodiments, VGV 12A may have a substantially identical construction as VGV 12B. Button 40B may have leading end 54B and trailing end 56B. Leading end 54B may be a foremost region of button 40B toward oncoming fluid flow F when the vane angle α of VGV 12B is at the zero orientation shown in FIG. 2A. In other words, leading end 54B of button 40B may be disposed at an angular position corresponding to an angular position of leading edge 42B of airfoil 38B relative to vane axis VB. Trailing end 56B may be diametrically opposed to leading end 54B and may be a rearmost region of button 40B in relation to the oncoming fluid flow F.

Depression 48B may define a sunken portion of platform surface 46B that is lower than a leading end portion 58B of platform surface 46B at or adjacent leading end 54B of button 40B. In some embodiments, some of platform surface 46B outside of depression 48B may be substantially flush with shroud surface 36 when vane angle α of VGV 12B is at the zero orientation shown in FIG. 2A. Accordingly, platform surface 46B and shroud surface 36 may cooperatively define a relatively smooth boundary of gas path 32 with little discontinuity for interacting with fluid flow F when vane angle α of VGV 12B is at the zero orientation.

Shroud surface 36 may be non-parallel to central axis A in some embodiments. For example, shroud surface 36 may be oriented obliquely to central axis A depending on the location of VGV 12B along gas path 32. In some embodiments, button 40B may have a non-uniform (e.g., tapered) configuration where a thickness T1 at leading end 54B of button 40B may be greater than a thickness T2 at trailing end 56B. The specific configuration of button 40B may depend on the orientation of shroud surface 36 and also the orientation of vane axis VB so that some or a majority of platform surface 46B may be substantially flush with shroud surface 36.

Depression 48B may have location D of maximum depth relative to one or more portion(s) of platform surface 46B outside of depression 48B. Location D of depression 48B may also be below shroud surface 36. Depression 48B may be disposed closer to leading end 54B of button 40B than to trailing end 56B of button 40B along central axis A. Also, location D of maximum depth may be disposed closer to leading end 54B of button 40B than to trailing end 56B of button 40B along central axis A. At location D of depression 48B, button 40B may have a thickness T3. In some embodiments, thickness T1 of button 40B at leading end 54B may be greater than thickness T3. In some embodiments, thickness T3 may be greater than thickness T2 of button 40B at trailing end 56B. As shown in FIG. 5, thicknesses T1, T2 and T3 may be measured along a direction substantially parallel to vane axis VB.

Figure 6A:
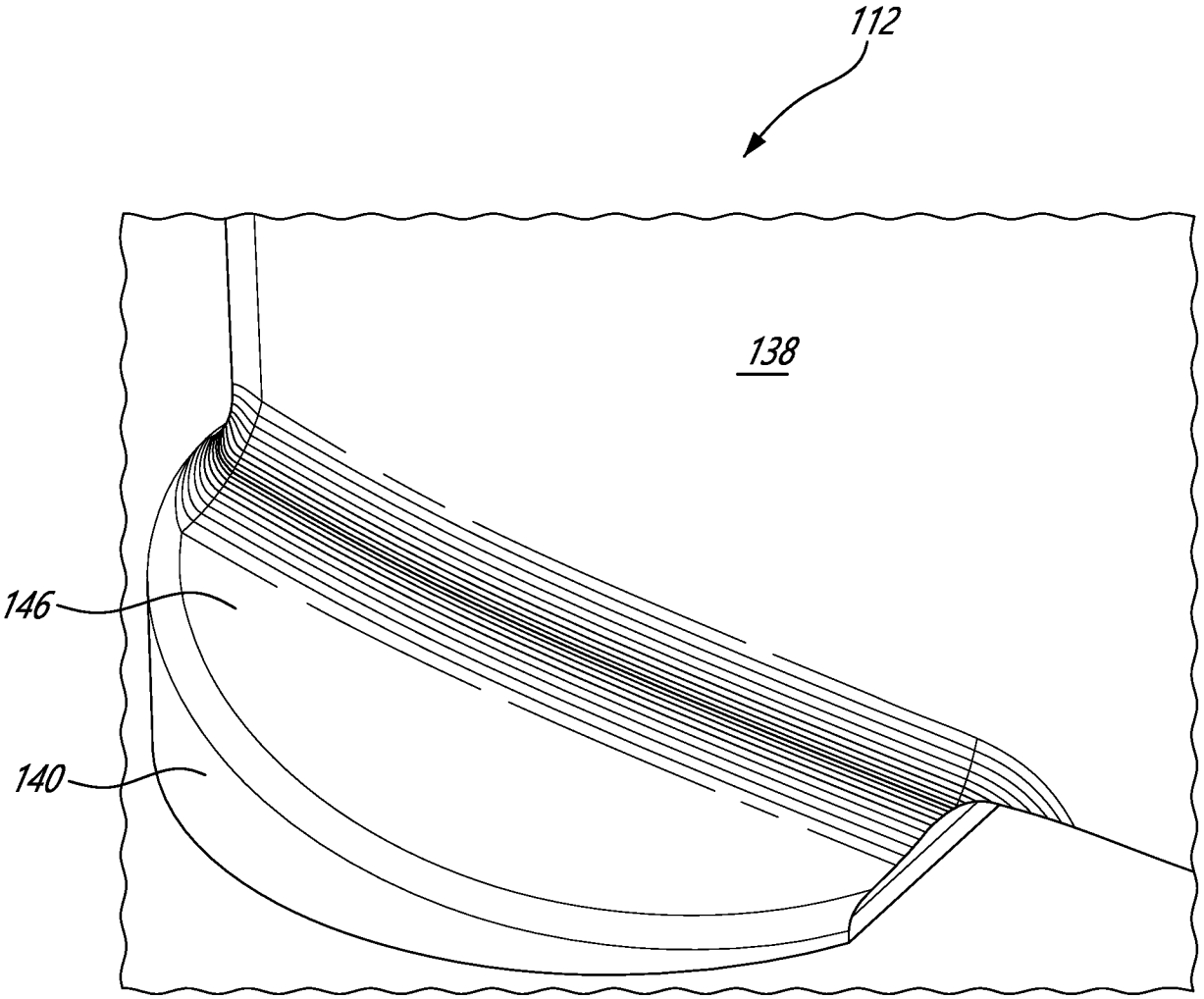
FIG. 6A is a tridimensional view of an exemplary button of a variable orientation guide vane without a depression formed therein showing a baseline geometry of a platform surface of the button.

FIG. 6A is an enlarged tridimensional view of an exemplary button 140 of VGV 112 without depression 48B formed therein showing a reference/baseline geometry of platform surface 146 of button 140 to which airfoil 138 may be mounted. VGV 112 may have a construction substantially identical to VGV 12A except for the lack of depression 48B. Like elements are identified using reference numerals that have been incremented by 100. Depending on the process selected for manufacturing VGV 12B, VGV 112 may, in some embodiments, be a precursor to VGV 12B before the forming (e.g., machining) of depression 48B into button 140.

Figure 6B:
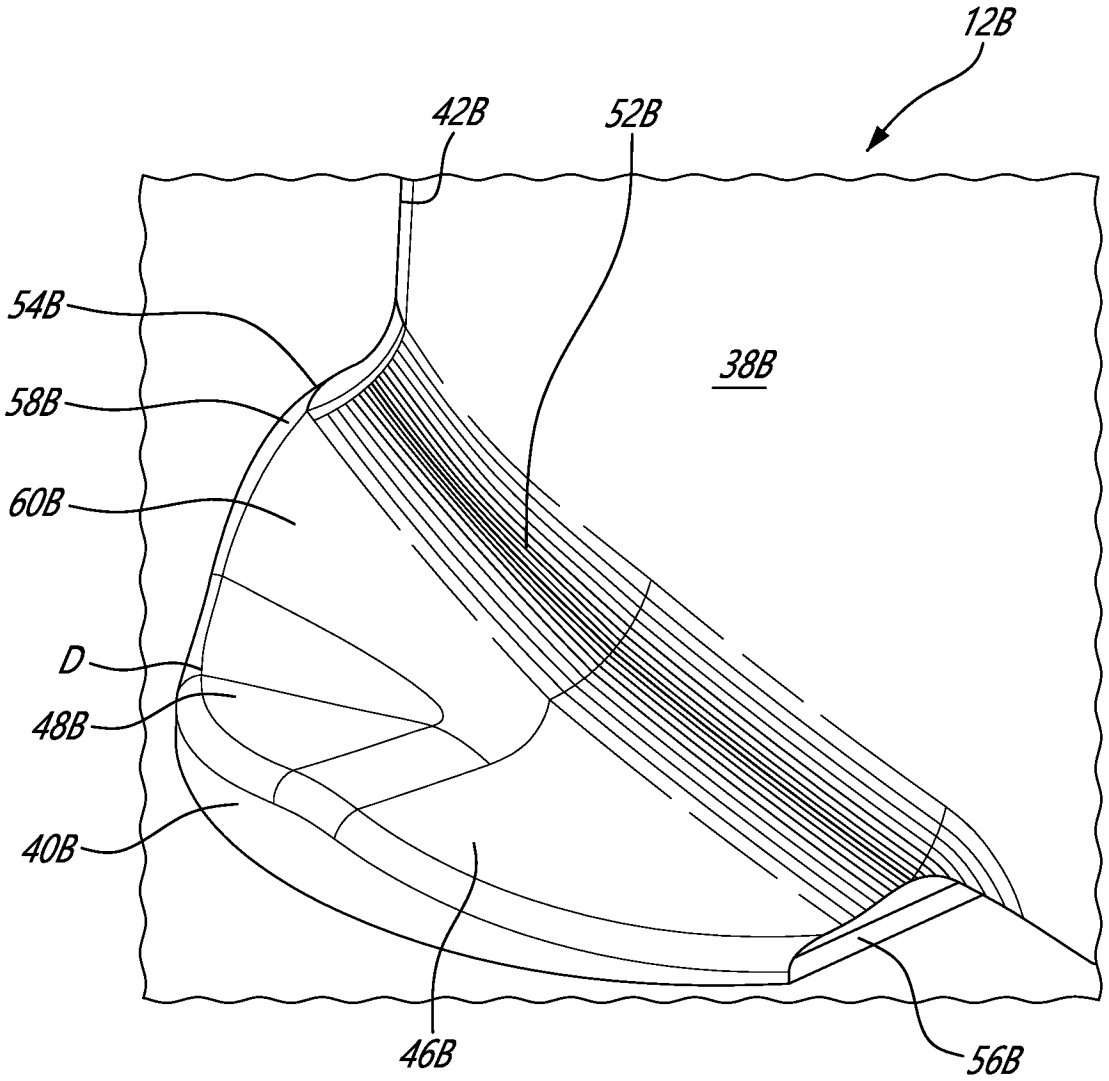
FIG. 6B is a tridimensional view of the button of FIG. 6A with a depression formed in the platform surface.

FIG. 6B is an enlarged tridimensional view of button 40B in isolation showing depression 48B formed in platform surface 46B. Depression 48B may have a concave shape facing gas path 32 (shown in FIG. 5). Depression 48B may be disposed outside of fillet 52B defined at the junction of button 40B and airfoil 38B. Depression 48B may include a periphery of button 40B (i.e., be radially outwardly open) to permit part of VGV 12A to laterally enter depression 48B and overlap button 40B at larger (i.e., more aggressive) vane angles α. For example, location D of maximum depth may be disposed at or near a periphery of button 40B. Accordingly, the depth of depression 48B may gradually increase toward the periphery of button 40B.

In some embodiments, depression 48B may have a generally streamlined/contoured overall shape to provide favorable aerodynamic conditions. The shape, size and location of depression 48B may be selected based on spatial constraints and the clearance desired for specific applications and vane geometries. For example, depression 48B may include one or more transition surfaces 60B that provide smooth/blended transitions with surrounding portion(s) of platform surface 46B disposed outside of depression 48B. In some embodiments, transition surface 60B may provide a fillet surface blend with a portion of platform surface 46B disposed outside of depression 48B. In some embodiments, transition surface 60B may provide a tangent-continuous type of surface continuity with a portion of platform surface 46B disposed outside of depression 48B. In some embodiments, transition surface 60B may provide a curvature-continuous type of surface continuity with a portion of platform surface 46B disposed outside of depression 48B. In some embodiments, transition surface 60B may provide such type(s) of surface continuity with leading end portion 58B of platform surface 46B at or adjacent leading end 54B of button 40B.

Figure 7:
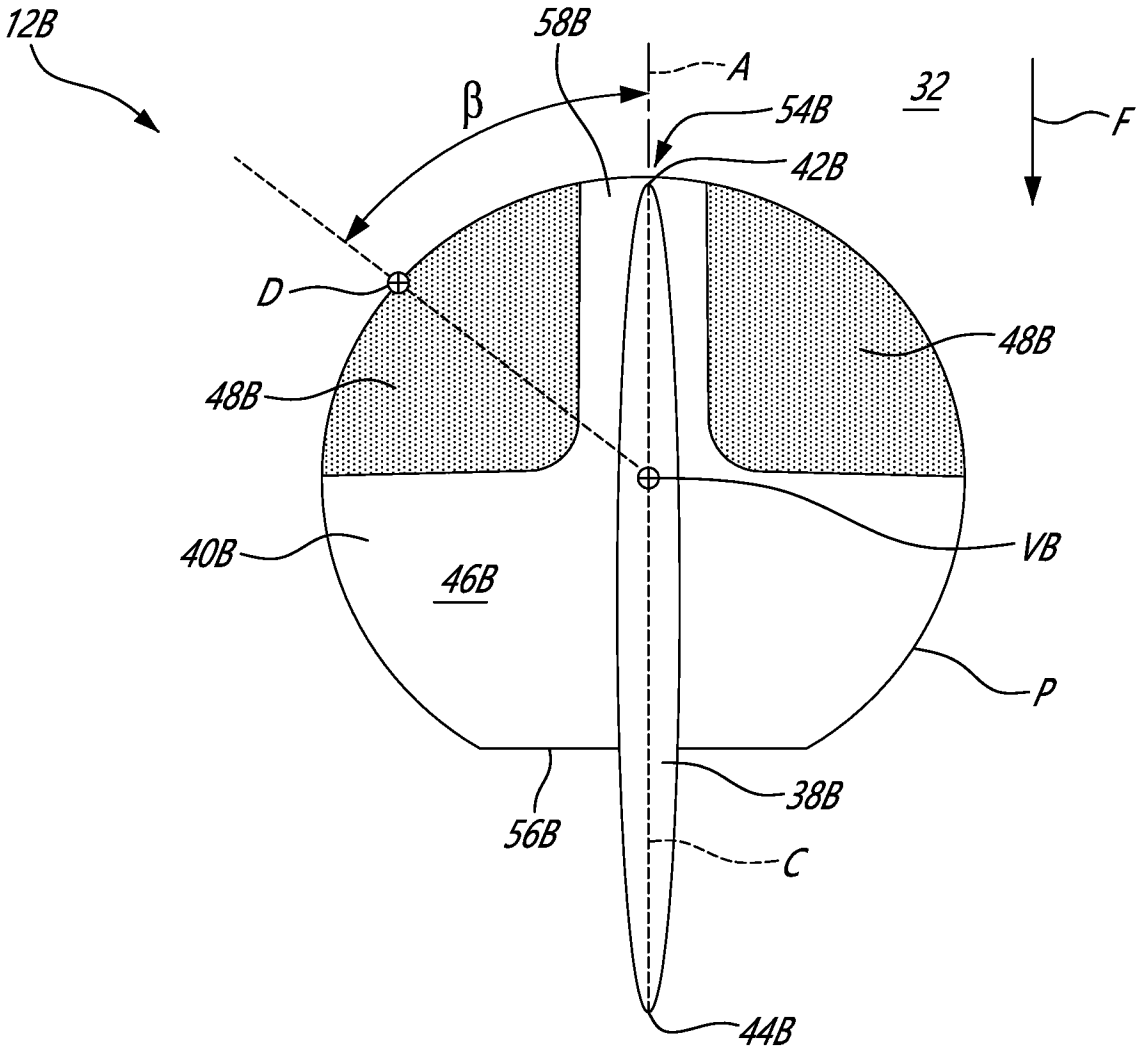
FIG. 7 is a schematic top view of the variable orientation guide vane of FIG. 6B.

FIG. 7 is a schematic top view of VGV 12B. Depression 48B may be disposed in a forward left quadrant of button 40B. In some embodiments, depending on the range of orientation of VGVs 12, a second depression 48B may be disposed in an opposite forward right quadrant of button 40B. Both depressions 48B may be mirror images of each other or may be of different shapes and sizes depending on the clearance requirements on each side of airfoil 38B.

Depression 48B may be angularly offset from leading end 54B of button 40B relative to vane axis VB extending normal to the page in FIG. 7. Accordingly, in some embodiments, leading end 54B of button 40B may be devoid of any part of depression 48B. In other words, leading end 54B of button 40B may be outside of depression 48B. A location D of maximum depth of depression 48B may be angularly offset from leading end 54B of button 40B. In some embodiments, location D of maximum depth of depression 48B may be angularly offset from leading end 54B by an angle β between 30 degrees and 60 degrees relative to vane axis VB for example.

As viewed along vane axis VB, button 40B may have periphery P. In various embodiments, periphery P may be partially or entirely circular, or of another shape. For example, a majority of periphery P of button 40B may be substantially circular. Part of periphery P at and near trailing end 56B may be non-circular (e.g., linear). In some embodiments, leading edge 42B of airfoil 38B may be disposed within periphery P. In some embodiments, trailing edge 44B of airfoil 38B may be disposed outside of periphery P.

Figure 8:
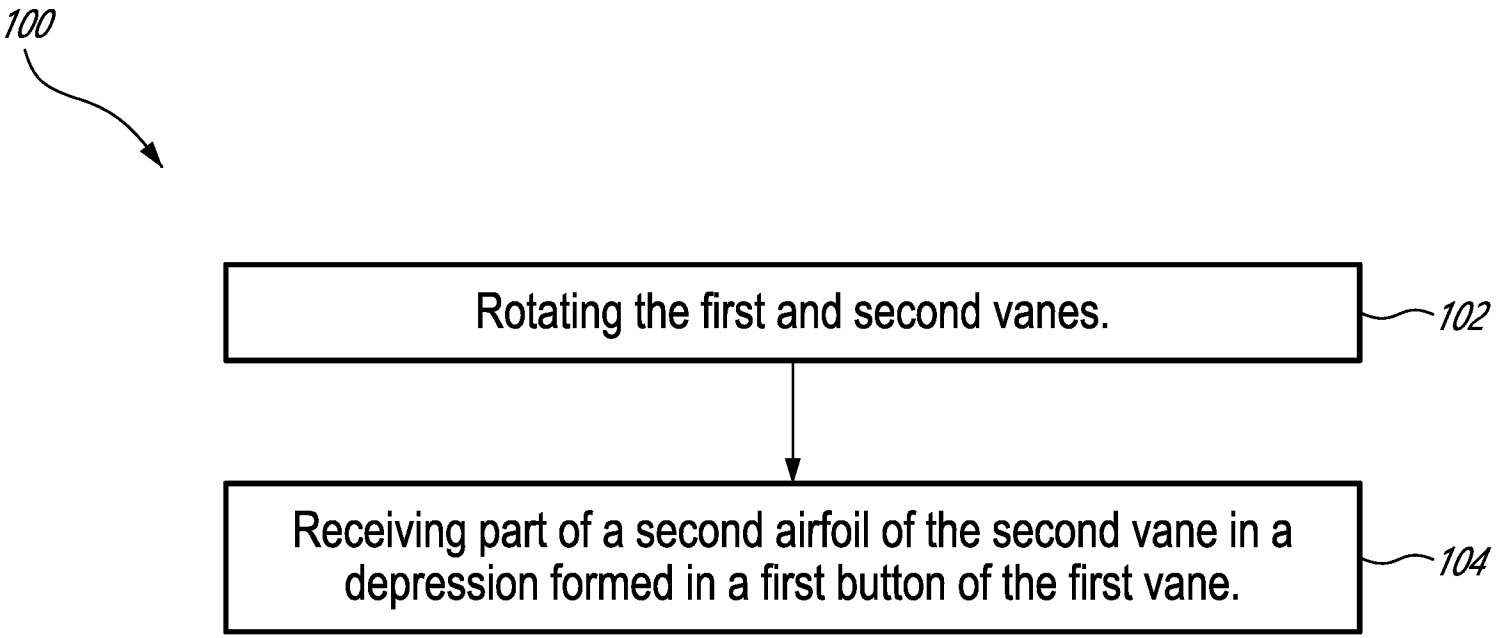
FIG. 8 is a flowchart of a method of operating variable orientation guide vanes.

FIG. 8 is a flowchart of a method 100 of operating VGVs 12A, 12B described herein or using other VGVs. Aspects of method 100 may be combined with aspects of VGVs 12A, 12B and with other methods or actions disclosed herein. In various embodiments, method 100 may include:

rotating first and second VGVs 12A, 12B in (e.g., annular) gas path 32 (block 102); and when rotating the first and second vanes, receiving part of VGV 12A in depression 48B formed in button 40B of VGV 12B.

In various embodiments, button 40B may be disposed radially inwardly or radially outwardly of airfoil 38B of VGV 12B.

In reference to periphery P shown in FIG. 7, the part (e.g., of trailing edge 44A) of VGV 12A may be disposed inside periphery P of button 40B when the part of VGV 12A is received in depression 48B. In other words, the part (e.g., of trailing edge 44A) of VGV 12A may radially overlap platform surface 46B of button 40B when the part of VGV 12A is received in depression 48B.

The embodiments described in this document provide non-limiting examples of possible implementations of the present technology. Upon review of the present disclosure, a person of ordinary skill in the art will recognize that changes may be made to the embodiments described herein without departing from the scope of the present technology. Yet further modifications could be implemented by a person of ordinary skill in the art in view of the present disclosure, which modifications would be within the scope of the present technology.

What is claimed is:

1. A variable orientation guide vane for a gas turbine engine, the variable orientation guide vane comprising:

an airfoil for interacting with a fluid in a gas path of the gas turbine engine, the airfoil having a leading edge and a trailing edge; and a button, the airfoil being mounted to the button and rotatable with the button about an axis during use, the button having a leading end at an angular position corresponding to an angular position of the leading edge of the airfoil relative to the axis, the button including a platform surface for facing the fluid in the gas path and defining part of the gas path during use, the platform surface including a depression for receiving therein part of an adjacent variable orientation guide vane, the depression defining a sunken portion of the platform surface that is lower than a leading end portion of the platform surface at or adjacent the leading end of the button.

2. The variable orientation guide vane as defined in claim 1, wherein a location of a maximum depth of the depression is angularly offset from the leading end of the button by an angle between 30 degrees and 60 degrees relative to the axis.

3. The variable orientation guide vane as defined in claim 1, wherein a location of a maximum depth of the depression is closer to the leading end of the button than to a trailing end of the button.

4. The variable orientation guide vane as defined in claim 1, wherein:

the button has a first thickness along the axis at the leading end of the button; and the first thickness of the button is greater than a second thickness of the button along the axis at a location of maximum depth of the depression.

5. The variable orientation guide vane as defined in claim 1, wherein the depression is disposed outside of a fillet transition between the button and the airfoil.

6. The variable orientation guide vane as defined in claim 1, wherein:

the button includes a periphery viewed along the axis;

the leading edge of the airfoil is disposed inside the periphery; and the trailing edge of the airfoil is disposed outside the periphery.

7. The variable orientation guide vane as defined in claim 1, wherein the depression includes a transition surface providing tangent-continuous surface continuity with an outside portion the platform surface outside of the depression.

8. The variable orientation guide vane as defined in claim 1, wherein the depression includes a transition surface providing tangent-continuous surface continuity with the leading end portion of the platform surface.

9. A variable guide vane assembly for a gas turbine engine, the variable guide vane assembly comprising:

a shroud including a shroud surface defining a first part of an annular gas path of the gas turbine engine, the shroud including a receptacle defined in the shroud surface;

a first vane rotatably mounted inside the annular gas path, the first vane including a button and a first airfoil mounted to the button, the button being received in the receptacle of the shroud, the button including a platform surface defining a second part of the annular gas path adjacent the first airfoil, the platform surface including a depression defining a sunken portion of the platform surface; and a second vane rotatably mounted inside the annular gas path adjacent the first vane, the second vane including a second airfoil, the second vane being rotatable between: a first orientation where a part of the second airfoil of the second vane is outside of the depression in the platform surface of the first vane; and a second orientation where the part of the second airfoil of the second vane is inside the depression in the platform surface of the first vane.

10. The variable guide vane assembly as defined in claim 9, wherein:

the first vane is rotatable within a range of orientations relative to a central axis of the annular gas path; and a surrounding portion of the platform surface outside of the depression is substantially flush with the shroud surface when a chord of the first vane is substantially parallel to the central axis of the annular gas path.

11. The variable guide vane assembly as defined in claim 9, wherein:

the first vane is rotatable about an axis;

the button has a first thickness along the axis at a leading end of the button; and the first thickness of the button is greater than a second thickness of the button along the axis at a location of maximum depth of the depression.

12. The variable guide vane assembly as defined in claim 9, wherein the button is disposed radially inwardly of the first airfoil relative to the annular gas path.

13. The variable guide vane assembly as defined in claim 9, wherein the part of the second airfoil of the second vane is a trailing edge of the second airfoil.

14. The variable guide vane assembly as defined in claim 9, wherein the depression is disposed closer to a leading end of the button than to a trailing end of the button.

15. The variable guide vane assembly as defined in claim 9, wherein the sunken portion of the depression is lower than a leading end portion of the platform surface at or adjacent a leading end of the button.

16. The variable guide vane assembly as defined in claim 15, wherein the depression includes a transition surface providing tangent-continuous surface continuity with the leading end portion of the platform surface of the button.

17. A method of operating adjacent variable orientation first and second vanes disposed in an annular gas path of a gas turbine engine, the first vane having a first button and a first airfoil mounted to the first button, the second vane having a second button and a second airfoil mounted to the second button, the first and second buttons being rotatably disposed in respective receptacles formed in a shroud defining part of the annular gas path, the first button including a platform surface including a depression defining a sunken portion of the platform surface, the method comprising:

rotating the first and second vanes; and when rotating the first and second vanes, receiving part of the second airfoil of the second vane in the depression formed in the first button of the first vane.

18. The method as defined in claim 17, wherein the first button is disposed radially inwardly of the airfoil of the first vane.

19. The method as defined in claim 17, wherein the part of the second airfoil of the second vane radially overlaps the platform surface of the first vane relative to the annular gas path when the part of the second airfoil of the second vane is received in the depression formed in the first button of the first vane.

20. The method as defined in claim 17, wherein:

the first vane is rotatable about an axis;

the first button has a periphery viewed along the axis; and a trailing edge of the second airfoil of the second vane is disposed inside the periphery of the first button when the part of the second vane of the second airfoil is received in the depression.

* * * * *